US011400476B2

(12) United States Patent
Fink

(10) Patent No.: US 11,400,476 B2
(45) Date of Patent: Aug. 2, 2022

(54) CARRYING DEVICE FOR RECEIVING A PIPELINE ELEMENT, ASSOCIATED TRANSPORT SYSTEM, AND PRODUCTION METHOD

(71) Applicant: Minimax Viking Research & Development GmbH, Bad Oldesloe (DE)

(72) Inventor: Thomas Fink, Bad Schwartau (DE)

(73) Assignee: Minimax Viking Research & Development GmbH, Bad Oldesloe (DE)

( * ) Notice: Subject to any disclaimer, the term of this patent is extended or adjusted under 35 U.S.C. 154(b) by 0 days.

(21) Appl. No.: 17/252,726

(22) PCT Filed: Jun. 27, 2019

(86) PCT No.: PCT/EP2019/067235
§ 371 (c)(1),
(2) Date: Dec. 15, 2020

(87) PCT Pub. No.: WO2020/002542
PCT Pub. Date: Jan. 2, 2020

(65) Prior Publication Data

US 2021/0213477 A1 Jul. 15, 2021

(30) Foreign Application Priority Data

Jun. 27, 2018 (DE) ..... 10 2018 115 537.9

(51) Int. Cl.
*B05C 13/02* (2006.01)
*B05B 13/02* (2006.01)

(52) U.S. Cl.
CPC ..... *B05B 13/0214* (2013.01); *B05B 13/0264* (2013.01); *B05B 13/0292* (2013.01); *B05C 13/02* (2013.01)

(58) Field of Classification Search
CPC ..... B05C 13/025; B65G 2201/0217; B65G 49/0409; B65B 19/025; B65B 17/485;
(Continued)

(56) References Cited

U.S. PATENT DOCUMENTS 1,097,273 A 5/1914 Tyler
3,906,894 A 9/1975 Pesapane
(Continued)

FOREIGN PATENT DOCUMENTS

DE 692 01 127 T2 5/1995
DE 20 2010 01566 11/2011
(Continued)

OTHER PUBLICATIONS

International Search Report, International Application No. PCT/EP2019/067235, 7 pages (dated Jan. 13, 2020).
(Continued)

*Primary Examiner* — Charles Capozzi
(74) *Attorney, Agent, or Firm* — Perkins Coie LLP

(57) ABSTRACT

The invention relates to a carrying device (2) for receiving pipeline elements (4) in a surface coating installation, having a main body (6), an attachment section (28) which is formed on the main body (6) and which serves for the attachment of the carrying device (2) to a ceiling-mounted conveying mechanism, and multiple cantilevers (8) extending laterally from the main body (6). Each cantilever (8) has arranged thereon a receptacle (10) with support feet (12, 12') arranged in pairwise fashion and spaced apart from one another, wherein the support feet (12, 12') are configured to come into contact with in each case one outer wall section of a pipeline element (14) in order to hold the pipeline element (14) between the support feet (12, 12').

37 Claims, 8 Drawing Sheets

(58) Field of Classification Search
CPC ..... B05B 13/0264; B05B 13/0292; A47F 7/0035; A47F 7/0021
USPC ..... 414/22.62, 22.68, 24, 746.8; 211/85.18, 211/85.22; 118/DIG. 13; 269/54.4
See application file for complete search history.

(56) References Cited

U.S. PATENT DOCUMENTS

| | | | | |
|---|---|---|---|---|
| 4,331,230 | A | 5/1982 | Buckley | |
| RE48,284 | E | 10/2020 | Rönpagel et al. | |
| 2003/0141267 | A1* | 7/2003 | Lloyd ..... | C25D 17/06 204/297.06 |
| 2009/0194422 | A1 | 8/2009 | Koltse et al. | |
| 2016/0333480 | A1 | 11/2016 | Porodo et al. | |
| 2019/0358477 | A1 | 11/2019 | Rönpagel et al. | |

FOREIGN PATENT DOCUMENTS

| | | | |
|---|---|---|---|
| EP | 1 059 365 | A1 | 12/2000 |
| EP | 2 623 163 | A1 | 8/2013 |
| EP | 2 766 653 | B1 | 11/2016 |
| WO | WO 2020/002486 | A1 | 1/2020 |
| WO | WO 2020/002498 | A1 | 1/2020 |
| WO | WO 2020/002542 | A2 | 1/2020 |

OTHER PUBLICATIONS

International Written Opinion (German and English translation), International Application No. PCT/EP2019/067235, 14 pages (dated Jan. 13, 2020).

English translation of International Search Report, International Application No. PCT/EP2019/067235, 7 pages (dated Jan. 13, 2020).

* cited by examiner

CARRYING DEVICE FOR RECEIVING A PIPELINE ELEMENT, ASSOCIATED TRANSPORT SYSTEM, AND PRODUCTION METHOD

PRIORITY CLAIM AND INCORPORATION BY REFERENCE

This application is a 35 U.S.C. § 371 application of International Application No. PCT/EP2019/067235, filed Jun. 27, 2019, which claims the benefit of German Application No. 10 2018 115 537.9, filed Jun. 27, 2018, each of which is incorporated by reference in its entirety.

TECHNICAL FIELD

The present invention relates to a carrying device for receiving pipeline elements in a surface coating installation, having a main body, an attachment section which is formed on the main body and which serves for the attachment of the carrying device to a ceiling-mounted conveying mechanism, and multiple cantilevers extending laterally from the main body. The invention furthermore relates to a system for transporting at least one pipeline element within a surface coating installation, having a ceiling-mounted conveying mechanism, and at least two carrying devices, which are attachable to the conveying mechanism, for receiving pipeline elements. In a further aspect, the invention relates to a method for producing a coated pipeline element, in particular a pipeline element of a fire extinguishing installation, and to a pipeline element of said type.

BACKGROUND AND SUMMARY OF THE INVENTION

Carrying devices for receiving pipeline elements in a surface coating installation are generally known. The carrying devices are typically designed with the aim of holding pipes in such a way that a seamless outer pipe coating is made possible.

For pipeline elements intended for use in fire extinguishing installations, particular challenges arise in that they are installed unused in objects for very long periods of time and, in the event of operation, must reliably and assuredly perform their task of transporting fluid. For example, fire extinguishing installations in which the pipeline systems carry extinguishing liquid even in the standby state, and alternatively those which do not yet carry extinguishing liquid in the sprinkler lines in the standby state, are widely used. In the case of the latter systems, the susceptibility to corrosion inside the pipes is a particular challenge, which is why efforts have been made to reduce the corrosion resistance of pipeline elements, in particular for fire extinguishing systems.

EP Application 1 2153 964 which published as EP 2 623 163 A1 and EP Application 1 2798 290 which published as EP 2 766 653 each describe systems and methods which achieve a significant improvement over the prior art. Said documents describe for the first time the use of polymer enhancement by autodeposition on the inside of the pipe in pipeline elements of fire extinguishing installations. The polymer enhancement described in said documents is extremely robust owing to the attained ionic bonding of a polymer-based coating material to the pipe surface and allows the use of simple metals that are not yet corrosion-resistant per se, in particular low-alloy steel types. At the same time, very low corrosion development, to the point of complete corrosion resistance, is achieved even over relatively long observation periods.

However, the industrial coating of the insides of pipes currently constitutes a particular challenge. It has been found that carrying devices already known from the prior art which are used to transport pipeline elements to different processing or coating positions in surface coating installations pose an obstruction to uniform coating of the insides of the pipes.

Carrying devices already known from the prior art have holding means which are introduced into the pipe interior at least in certain portions in order to allow gapless external coating of pipe elements. This however has the effect that, in the region of contact with a pipe element, an only inadequate coating can be applied to the inside of the pipe, and pipes that have been held by such carrying devices have corrosion-prone locations on the inside of the pipe.

Against this background, the invention was based on the object of further developing a carrying device of the type described at the outset such that the disadvantages found in the prior art are as far as possible eliminated. In particular, it was sought to specify a carrying device which ensures that pipeline elements are received securely and which at the same time allows improved coating.

According to the invention, the object is achieved in the case of a carrying device of the type mentioned at the outset in that, on each cantilever, there is arranged a receptacle with support feet arranged in pairwise fashion and spaced apart from one another, wherein the support feet are configured to come into contact with in each case one outer wall section of a pipeline element in order to hold the pipeline element between the support feet.

The invention is based on the recognition that, by means of such a carrying device with support feet arranged in pairwise fashion and spaced apart from one another, it can firstly be ensured that a pipeline element can be securely held by such a device and the pipeline element experiences a certain centering action, as it were, and it is at the same time ensured that flow can pass freely around the inside of the pipeline elements, and also, the outside is in contact with the carrying device only at limited, punctiform surface sections.

This advantageously makes it possible that a pipeline element can remain on the carrying device during the entire coating process, that is to say during the course of different coating steps, and can for example be dipped together with the carrying device into different coating baths. In this way, overall, it is not only the case that high coating quality, primarily on the inside, is ensured and at the same time a possibility is provided for transporting pipeline elements efficiently within a surface coating installation without such a pipeline element having to be separated from the carrying device. Furthermore, after the end of a coating process and after the pipeline elements have been removed from the carrying device, the carrying device can be easily separated from a ceiling-mounted conveying mechanism and then freed or stripped of the coating layer.

The invention is further developed in that the support feet arranged in pairwise fashion are oriented so as to face toward one another at an angle of 35° to 95°, preferably 60° to 75°, more preferably 62° to 72°, particularly preferably 64° to 70°. It has proven to be advantageous to use an angle of between 60° and 75° or one of the narrower ranges for pipes of DN150 and DN200 type, wherein the support angle for pipes of DN150 type is preferably greater than that for pipes of DN200 type. For large pipes, for example of DN250 or DN300 type, it has been proven to be advantageous to use an angle of 83° and 95°, preferably of 85° to 90°. In an alternative embodiment, which is provided in particular for pipes of DN100 or DN125 type, the support feet arranged in pairwise fashion are oriented so as to face toward one another preferably at an angle in the range of 45° to 55°, particularly preferably in the range of 48° to 52°.

It has been shown that an orientation of the support feet in the relevant angle range relative to one another for different pipeline element diameters is advantageously suitable for securely receiving the pipeline elements and centering them between the support feet. The risk that, for example, one of the pipeline elements, during the transport thereof by means of the carrying device according to the invention, slips off the carrying device can be minimized by means of the corresponding orientation of the support feet with respect to one another.

In a preferred embodiment, the support feet arranged in pairwise fashion have, at their end averted from the cantilever, a height of 30 mm to 80 mm, in particular 47 mm to 77 mm, in relation to the top side of the cantilever.

For the respective height range, it has been found for a large number of pipeline elements that these can be reliably flowed around by a coating fluid even in the region of the support feet, and it is thus also possible to ensure high coating quality in the vicinity of the contact region between support feet and pipeline element. Also for the application in which—for example in the case of a powder coating—a static charge is applied to either the powder or the pipeline element, it can be ensured by means of the support feet together, with the respective height of the support feet, that coating powder can distribute on the pipeline element uniformly and in a largely undisturbed manner.

It is furthermore preferable that the support feet have in each case one holding tip with a stump side and a tip side, wherein the holding tip has a greater diameter at the stump side than at the tip side.

Firstly, the stump side, which is of relatively large diameter, serves to provide basic strength and secure connectability to the cantilever. A relatively small diameter of the holding tip in the region of the tip side facing toward a pipeline element has proven to be advantageous for minimizing the contact area of the pipeline element with the holding tip in order to ensure that the coating is adversely affected by the holding tip only in a very limited outer wall section.

The invention is further developed in that the holding tip has a coupling recess at the stump side, and a plug-in portion which corresponds to the coupling recess is formed on a base section of the support feet. In this way, the holding tip and the base section of the support feet can be connected in a permanently durable manner.

In a preferred embodiment, the holding tip has a cylindrical section and has a conical section adjoining the cylindrical section, wherein the conical section, in particular the cone tip thereof, is configured to come into contact with a pipeline element. The respective component geometry of the holding tip has proven firstly to be adequately strong and rigid, but at the same time only minimally disrupts the flow around the pipeline element.

The invention is further developed in that the holding tip is formed as a separate, exchangeable component. Thus, on the one hand, the holding tip can be formed from a material that differs from the cantilever, and at the same time that component which is most likely to be subject to wear through direct contact with a pipeline element can be exchanged. A removal or stripping of coatings from the holding tips can also be performed more easily and economically if said holding tips are removable from the cantilever.

The holding tip is preferably formed from one of the following materials: machining steel, in particular 9SMn28K, nonferrous metal. Depending on the area of application with regard to the coating method to be used or also with regard to the pipeline element material to be received, the holding tip may preferably be formed from one of the materials mentioned. It is furthermore preferable for the holding tip to have a coating composed of a hard metal or of ceramic.

In a preferred refinement, the main body and/or the cantilever are formed partially or entirely from one of the following: sheet metal, in particular one-piece sheet metal, nonferrous metal. For the main body and/or the cantilever, too, the material selection may be made for example taking into consideration the coating method. For example, the formation of the main body and cantilever from sheet metal may be advantageous in order to introduce static charges into a pipeline element via the main body and cantilever. For other applications, in turn, the formation of the components from a non-conductive material may be advantageous. The formation of the main body as a one-piece component has also proven to be advantageous with regard to component durability.

The invention is further developed in that, on the main body, at least two cantilevers are arranged spaced apart from one another along a longitudinal axis of the main body. In other words, it is preferred that two or more cantilevers are arranged spaced apart one above the other during operation. This yields the advantage that several pipeline elements can be transported and coated by means of a single carrying device or by means of a combination of two carrying devices.

The spacing between a top side of a first cantilever and the bottom side of an adjacently arranged second cantilever is preferably 100 mm to 500 mm, in particular 130 mm to 435 mm.

In this way, it is ensured that the pipeline elements can be flowed around omnidirectionally in an optimal manner during a coating process and it is ensured that no disruption in coating quality arises from adjacent cantilevers with pipeline elements arranged thereon. A respective spacing of the cantilevers with respect to one another has furthermore proven to be advantageous for allowing the possibility of optimal thermal aftertreatment.

Furthermore, according to a preferred embodiment, the cantilevers have a substantially horizontal orientation during operation. Here, in the context of the present application, the "during operation" state is defined as the position in which the carrying device is attached to a ceiling-mounted conveying mechanism and the main body has a substantially vertical orientation and the cantilever has a substantially horizontal orientation. In the present case, the expression "substantially" is to be understood as encompassing deviations from the horizontal or vertical, which constitutes a reference, of ±10°.

In a preferred embodiment, the cantilever has a first side and a second side, wherein the cantilevers on the first side are arranged in alignment with or so as to be offset with respect to the cantilevers on the second side.

Firstly, the arrangement of cantilevers on the first side and on the second side has fundamental advantages in terms of statics, because, if both sides of the cantilevers are equally equipped with identical pipeline elements, a situation is avoided in which forces are introduced unilaterally via cantilevers and main body into the ceiling-mounted conveying mechanism.

A non-aligned, offset arrangement offers the advantage that the spacing between pipeline elements arranged on the first side and on the second side can be increased owing to the offset arrangement, whereby, depending on the type of coating and also depending on the pipeline element diameter, improved flow conditions around the pipeline elements can be achieved. Under certain circumstances, depending on the pipeline element diameter, the carrying device can be designed to be more compact in the case of an offset arrangement of the cantilevers on the first and second sides.

The invention has been described above with reference to a carrying device. In a further aspect, the invention relates to a system for transporting at least one pipeline element within a surface coating installation, having a ceiling-mounted conveying mechanism, and at least two carrying devices, which are attachable to the conveying mechanism, for receiving pipeline elements.

The invention achieves the object mentioned at the outset with regard to the system mentioned at the outset in that the carrying devices engage, spaced apart from one another, on the same pipeline element in each case, and are designed according to any of the exemplary embodiments mentioned above.

The system makes use of the same advantages and preferred embodiments as the carrying device according to the invention. In this regard, reference is made to the statements above, and the content thereof is incorporated here.

In a further aspect, the invention relates to a method for producing a coated pipeline element, in particular a pipeline element of a fire extinguishing installation.

The invention achieves the object mentioned at the outset with regard to the method by means of the steps: providing a pipeline element for coating, placing the pipeline element onto two carrying devices which are attached to a ceiling-mounted conveying mechanism, wherein at least one of the carrying devices is designed according to any of the exemplary embodiments mentioned above, conveying the pipeline element by means of the conveying mechanism to a coating facility, and coating the pipeline element in the coating facility.

The method also makes use of the same advantages and preferred embodiments as the carrying device according to the invention, and reference is again made to the statements above, and the content thereof is incorporated here. Furthermore, the method has the advantageous effect that the pipeline element only needs to be placed onto the carrying devices once and can then remain on the carrying devices during the coating process. The conveying mechanism with the carrying devices thus serves for transporting a pipeline element between different coating stations, but at the same time also serves as a receptacle and guide for the pipeline element during the individual coating steps. In summary, a highly automated coating method for pipeline elements can be implemented in which pipeline elements only need to be placed once onto a carrying device and can then be coated in a fully automated manner and without further changes in position.

The method is further developed in that the coating is performed in a polymer coating process, wherein the pipeline element remains on the carrying device during the coating process and, preferably, the pipeline element is inclined relative to a horizontal during the coating process.

The coating is preferably performed in particular by means of chemical autodeposition, preferably by dipping of the pipeline element into a dip bath which contains a polymer-based chemical autodeposition material.

The autodeposition material preferably comprises polymer constituents which are ionically bonded to the wall of the pipeline elements, and is preferably present as an aqueous emulsion or dispersion.

The autodeposition material is preferably acidic in its liquid phase, and particularly preferably has a pH in a range from 1 to 5, and particularly preferably a starter material in the form of metal halides. In particular iron halides, particularly preferably iron (III) fluoride, are proposed as metal halides for ferrous metals. In particular zinc halides are proposed as metal halides for zinc-containing metals.

The metal halides, by reacting on the surface of the pipeline elements, release metal ions, in the case of a ferrous pipeline element that is to say in particular iron ions, in particular $Fe2+$ ions, or in the case of a zinc-containing pipeline element in particular zinc ions, which destabilize the polymer constituents in the autodeposition material, resulting in an accumulation on the metal surface of the pipeline elements.

The autodeposition material preferably has, as polymer constituent, autodepositionable polymers preferably selected from the list comprising:

i) epoxides,
ii) acrylates,
iii) styrene acrylates,
iv) epoxy acrylates,
v) isocyanates, especially urethanes, such as polyurethanes,
vi) polymers with a vinyl group, for example polyvinylidene chloride, or
iv) a combination of two or more of i), ii) or iii), which are preferably crosslinked to one another, more preferably via an isocyanate, particularly preferably via a urethane.

In the method according to the invention, the dipping step is continued in one or more dipping processes until such time as the polymer-based layer applied to the inside of the pipeline element has a thickness in a range from 7 μm to 80 μm, preferably a thickness in a range from 7 μm to 30 μm. The stated values relate to the dry layer thickness and in particular to an increase in thickness relative to the uncoated state.

As an alternative or in addition to the polymer enhancement described above, in a preferred embodiment the coating comprises a powder coating method, wherein the pipeline element remains on the carrying device during the coating process. If both polymer enhancement and powder coating are to be performed, the powder coating is preferably performed after the application of the polymer-based layer, without the pipeline elements having to be removed from the carrying device in the interim. It is furthermore preferred that the pipeline element is subjected to at least partial thermal aftertreatment after the application of the surface coating. According to the first alternative embodiment, it is preferred that powder provided for the coating process is electrostatically charged before and/or during the coating process. The adhesion of the powder to the workpiece for coating, in particular to the pipeline element, can be positively influenced in this way, without the need, for example, for electrodes and the like to be attached to the element for coating.

According to a second preferred embodiment, the pipeline element provided for coating is electrostatically charged before and/or during the coating process. In the case of some pipeline element materials, such a procedure has proven to be advantageous in order to ensure a uniform and high-quality coating, in particular in the interior of a pipeline element.

In a further aspect, the invention relates to a pipeline element, in particular produced by means of a method according to any of the preferred embodiments described above, having a first end region and a second end region arranged opposite the first end region, having a wall with an inner surface and an outer surface, having a surface coating on the outer surface. The pipeline element has two uncoated sections arranged on the outer surface in the region of the ends of the encompassing wall.

This shows that, in comparison to previously known systems, the invention provides pipeline elements in the case of which it has been possible to reduce the surface area proportion to only 4 substantially punctiform uncoated locations. In particular, the inside of the pipeline element remains free from such defects.

According to an alternative embodiment, preferably two of the uncoated sections are arranged spaced apart from one another by an angle of 35° to 95°, 60° to 75°, more preferably 62° to 72°, particularly preferably 64° to 70°, along a circumference of the pipeline element. It has proven to be advantageous to use an angle of between 60° and 75° or one of the narrower ranges for pipes of DN150 and DN200 type, wherein the support angle for pipes of DN150 type is preferably greater than that for pipes of DN200 type. For large pipes, for example of DN250 or DN300 type, it has been proven to be advantageous to use an angle of 83° and 95°, preferably of 85° to 90°.

According to a further alternative embodiment, which is provided in particular for pipes of DN100 or DN125 type, it is preferable if two of the uncoated sections are arranged spaced apart from one another along the circumference of the pipeline element by an angle of 45° to 55°, particularly preferably by an angle of 48° to 52°.

It is furthermore preferable if a surface coating is arranged on the inner surface.

In a further preferred embodiment, the surface coating on the inner and outer surfaces is in the form of a polymer coating.

It is furthermore preferred that the surface coating on the outer surface has a powder coating in addition to the polymer-based layer or is formed as a powder coating.

In a further preferred embodiment, the pipeline element is formed from a metal suitable for chemical autodeposition, in particular a ferrous and/or zinc-containing metal, and the polymer-based layer contains a metallic constituent, preferably in the form of metal ions, that is to say particularly preferably in the form of iron ions in the case of a ferrous metal and in the form of zinc ions in the case of a zinc-containing metal.

It is furthermore preferable if the polymer-based layer has polymer constituents preferably selected from the list comprising:

i) epoxides,
ii) acrylates,
iii) styrene acrylates,
iv) epoxy acrylates,
v) isocyanates, especially urethanes, such as polyurethanes,
vi) polymers with a vinyl group, for example polyvinylidene chloride, or
iv) a combination of two or more of i), ii) or iii), which are preferably crosslinked to one another, more preferably via an isocyanate, particularly preferably via a urethane.

In a further preferred embodiment, the polymer-based layer has a thickness in a range from 7 μm to 80 μm, preferably a thickness in a range from 7 μm to 30 μm. The stated values relate to the dry layer thickness and in particular to an increase in pipe thickness relative to the uncoated state.

It is furthermore preferable that the pipeline element has a nominal diameter in a range from DN15 to DN300, preferably DN 32 to DN 80. Alternatively, the nominal width ranges in the inch system lie from ½" (NPS) to 12" (NPS), particularly preferably in a range from 1¼" (NPS) to 3" (NPS).

Preferably, the pipeline element has a longitudinal axis and a pipe length in the direction of the longitudinal axis in a range of 1 m or more, more preferably in a range of 3 m or more, particularly preferably in a range of 5 m or more.

BRIEF DESCRIPTION OF THE DRAWINGS

The invention will be described in more detail below with reference to the accompanying figures and with reference to preferred exemplary embodiments.

MODE(S) FOR CARRYING OUT THE INVENTION

Figure 1:
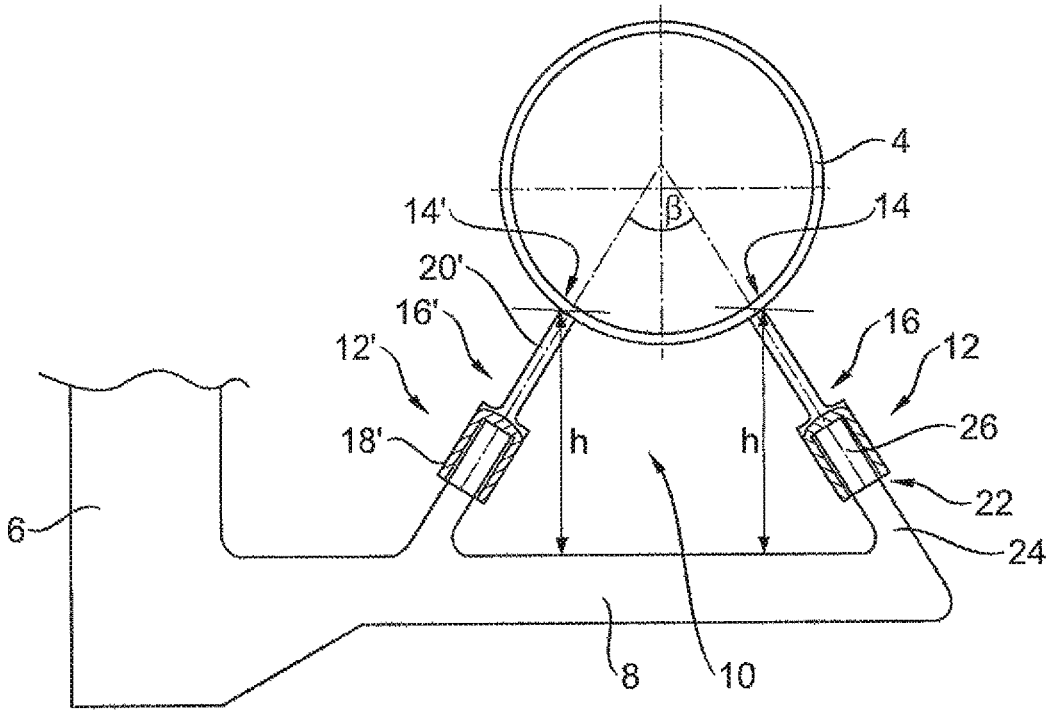
FIG. 1 shows a detail of a first exemplary embodiment of a carrying device according to the invention in a side view.

FIG. 1 is an enlarged detail illustration of a section of a carrying device 2 according to the invention. The carrying device 2 has a main body 6 which is only partly shown in FIG. 1. A cantilever 8 is arranged on the main body 6. In the present case, during operation, that is to say in a state in which the carrying device 2 is connected to a ceiling-mounted conveying mechanism (not shown), the main body 6 extends in a vertical direction, whereas, in the operating position, the cantilever 8 extends in a horizontal direction.

A receptacle 10 for receiving a pipeline element 4 is arranged on the cantilever 8. The receptacle 10 has two support feet 12, 12' which are oriented so as to face toward one another. The angle of inclination by which the support feet 12, 12' face toward one another is denoted by β. The support feet 12, 12' come into contact with wall sections 14, 14' of the pipeline element 4. Said wall sections of the pipeline element 14, 14' are situated on the outside of the pipeline element 4. The support feet 12, 12' are of two-part form. Firstly, a base section of the support feet 24, 24' is arranged directly adjacent to the cantilever 8. The base section of the support feet 24, 24' is formed, in the direction of its end, as a plug-in section 26, 26'.

A holding tip 16, 16' can be applied to the plug-in section 26, 26'. The holding tip 16, 16' itself has a stump side 18, 18' and a tip side 20, 20'. In the stump side 18, 18', there is formed a coupling recess 22, 22' which corresponds to the plug-in section 26, 26' of the base section of the support feet 24, 24'. In this way, the holding tip 16, 16' is arranged exchangeably on the base section of the support feet 24, 24'.

To allow a substantially undisrupted flow around the pipeline element 4 during a coating process, that section of the holding tip 16, 16' which faces toward the pipe element 4 is spaced apart from the top side of the cantilever 8 by the height h.

Figure 2:
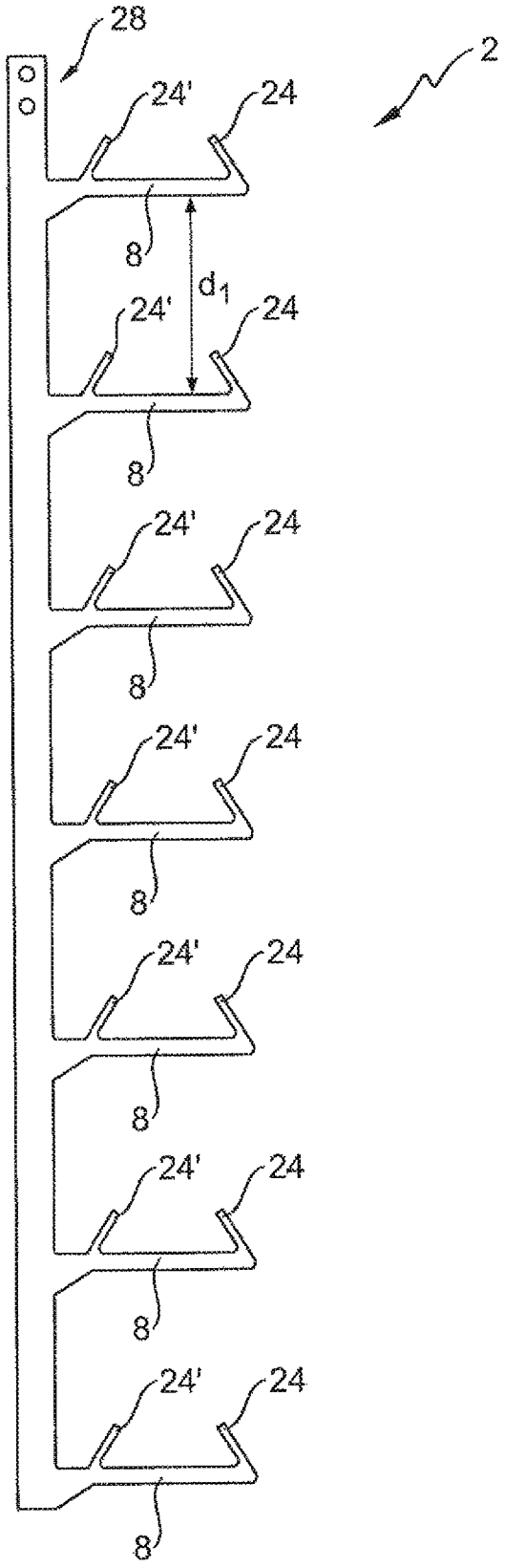
FIG. 2 shows the exemplary embodiment of the carrying device according to the invention as per FIG. 1 in a side view.

FIG. 2 shows a complete exemplary embodiment of a carrying device 2. As can be seen from the figure, a total of seven cantilevers 8 is arranged on the main body 6. Here, the cantilevers 8 extend in one direction from the main body 6. To ensure an as far as possible undisrupted flow around pipeline elements 4 that can be arranged on the carrying device 2, respectively adjacent cantilevers 8 have a spacing d1. Said spacing d1 is dimensioned very substantially in accordance with the pipeline element diameter for which a carrying device 2 is provided and designed. The base sections of the support feet 24, 24' are also shown in the figure.

An attachment section 28 is furthermore formed on the main body 6. Said attachment section 28 serves for the attachment of the carrying device 2 to a conveying device, in particular to a ceiling-mounted conveying mechanism.

Figure 3:
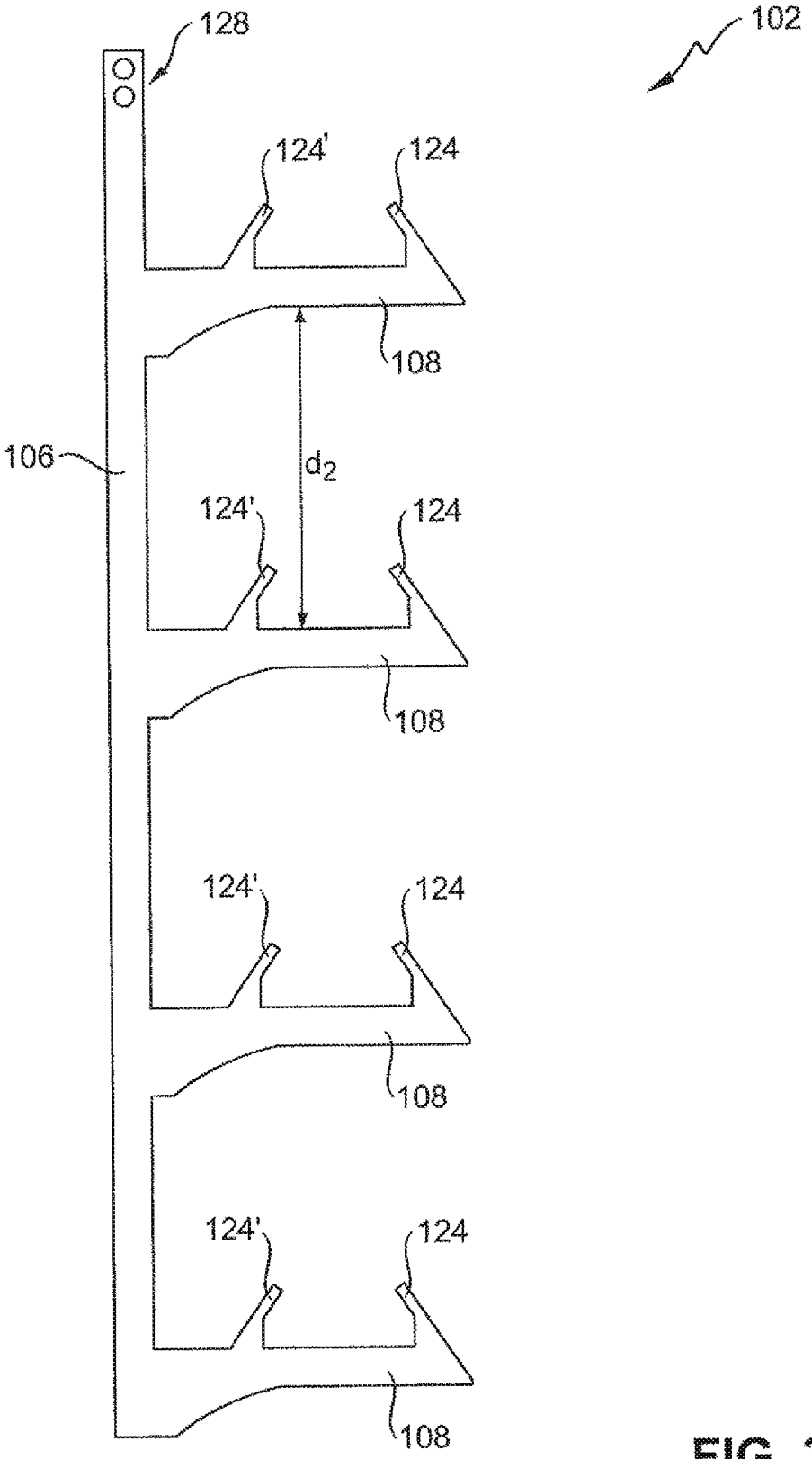
FIG. 3 shows a second alternative exemplary embodiment of a carrying device according to the invention in a side view.

An alternative exemplary embodiment of a carrying device 102 is shown in FIG. 3. Again, the carrying device 102 has a main body 106 on which cantilevers 108 are arranged. In the present case, the carrying device 102 has four cantilevers 108, wherein adjacent cantilevers 108 are spaced apart with a spacing d2. In comparison with the exemplary embodiment shown in FIG. 2, the carrying device 102 is designed and provided for larger pipeline element diameters. The enlarged spacing d2 between two cantilevers 108 ensures that, even in the case of larger pipeline element diameters, air flows around these in the most effective possible manner during a coating process, which is of particular relevance in particular in the case of powder coating operations. In relation to the cantilevers 8 shown in FIG. 2, the cantilevers 108 also have greater material thicknesses in order to accommodate the higher weight of pipeline elements 4 with larger diameters. It should be noted that only the base sections of the support feet 124, 124' are shown in FIG. 3, but not the corresponding holding supports 116, 116'.

Figure 4:
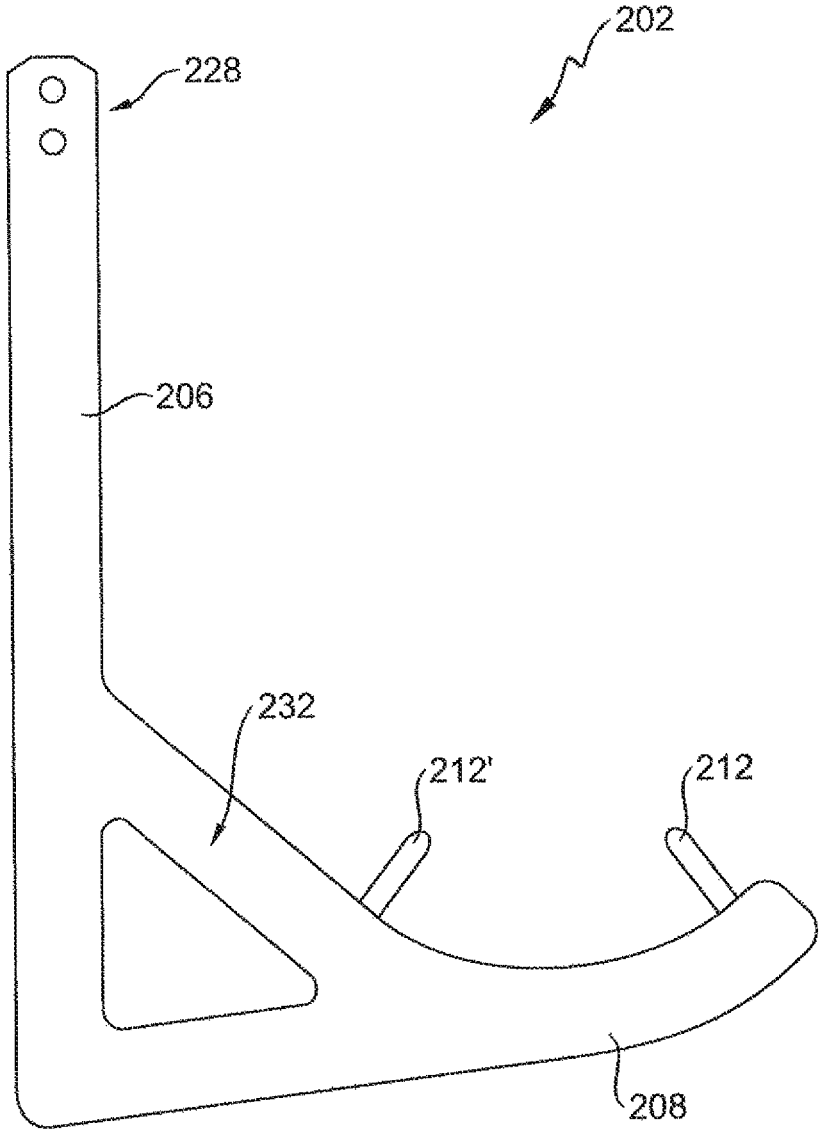
FIG. 4 shows a third alternative exemplary embodiment of a carrying device according to the invention in a side view.

A further alternative exemplary embodiment of a carrying device 202 is shown in FIG. 4. Again, the carrying device 202 has a main body 206 on which a cantilever 208 is arranged. The carrying device 202 is attachable by means of an attachment section 228 for example to a ceiling-mounted conveying mechanism. Support feet 212, 212' are situated on the cantilever 208. In comparison with the carrying devices 202 and 102 shown in FIGS. 2 and 3, the carrying device 202 shown in FIG. 4 is suitable for even larger pipeline element diameters. For this purpose, the cantilever 208 has a strut 232, and the carrying device 228 is configured to receive only a single pipeline element 4.

Figure 5:
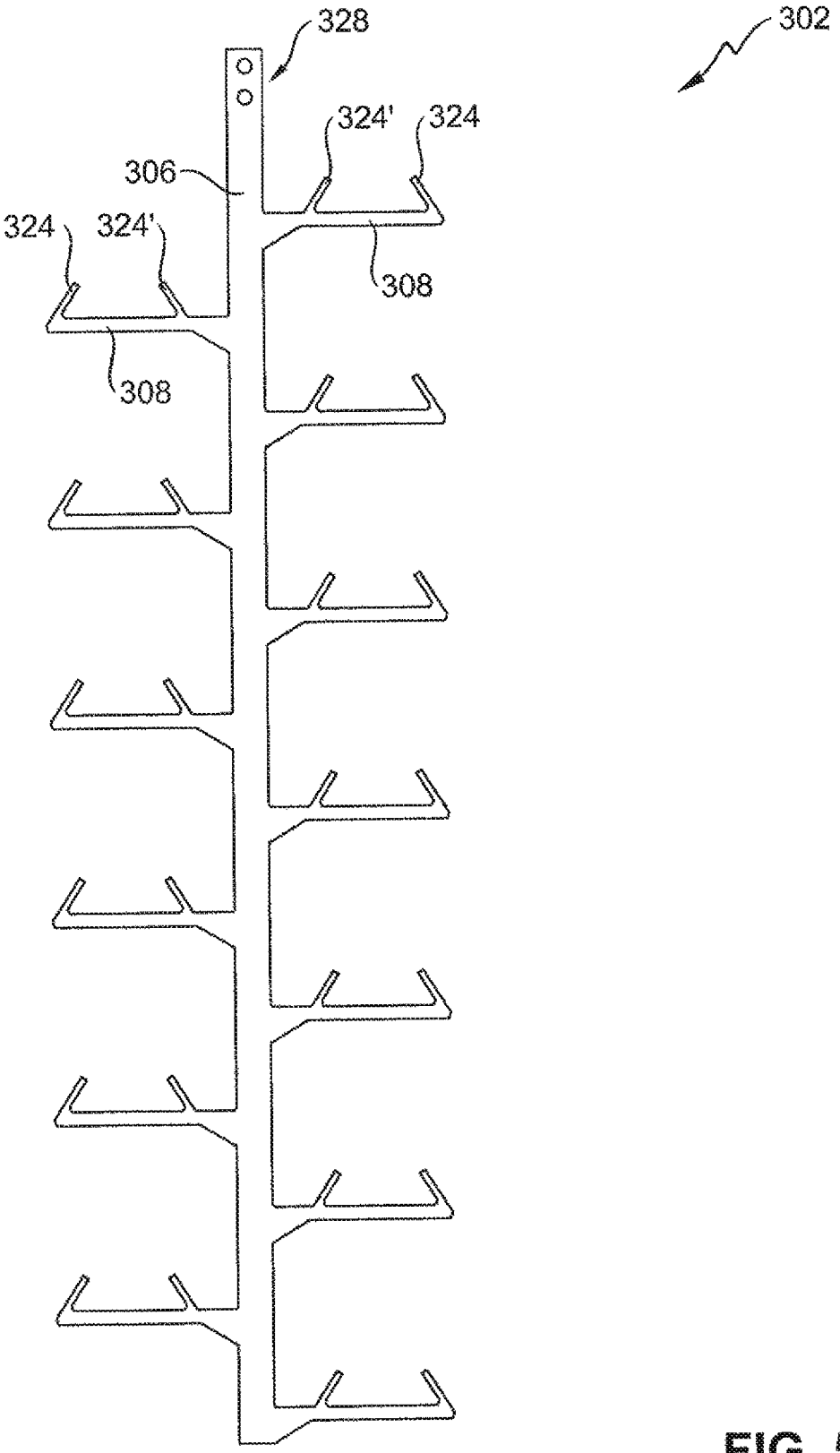
FIG. 5 shows a fourth alternative exemplary embodiment of a carrying device according to the invention in a side view.

A further alternative exemplary embodiment of a carrying device 302 is finally also shown in FIG. 5. Cantilevers 308 are arranged on a main body 306, wherein the cantilevers 308 extend in a first direction (to the right proceeding from the main body 306 in the plane of the drawing) and in a second direction (to the left proceeding from the main body 306). It is thus possible, on the cantilevers 308 in each case on both sides of the main body 306, for pipeline elements 4 to be mounted with the aid of holding tips (not shown) onto the base sections of the support feet 324, 324'.

Figure 6:
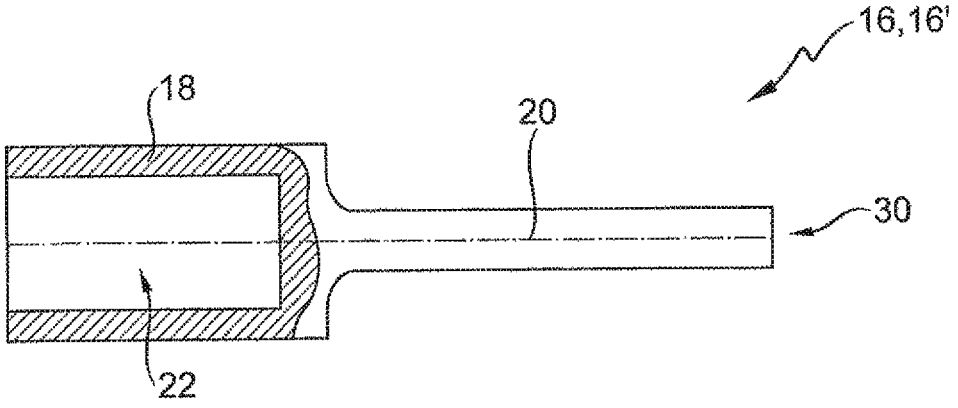
FIGS. 6 to 8 show holding tips according to the invention in side views.
Figure 7:
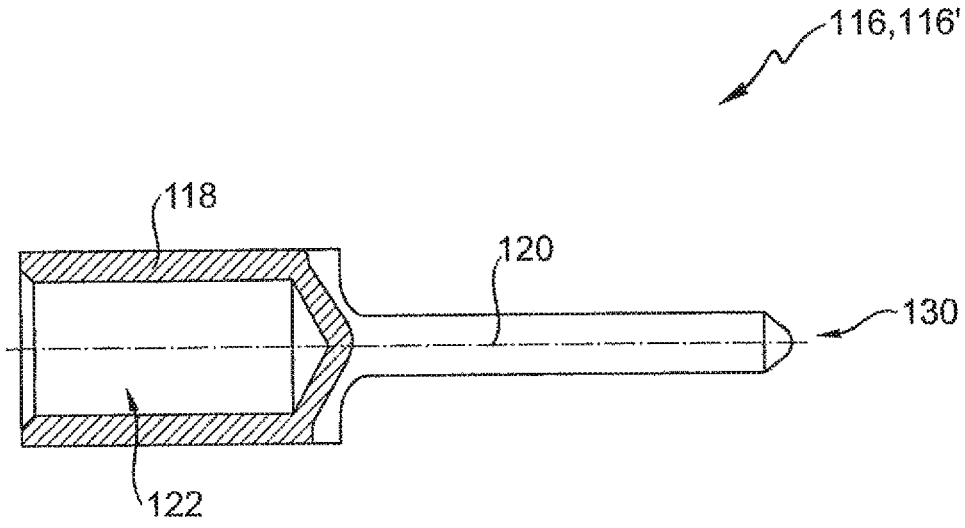
Figure 8:
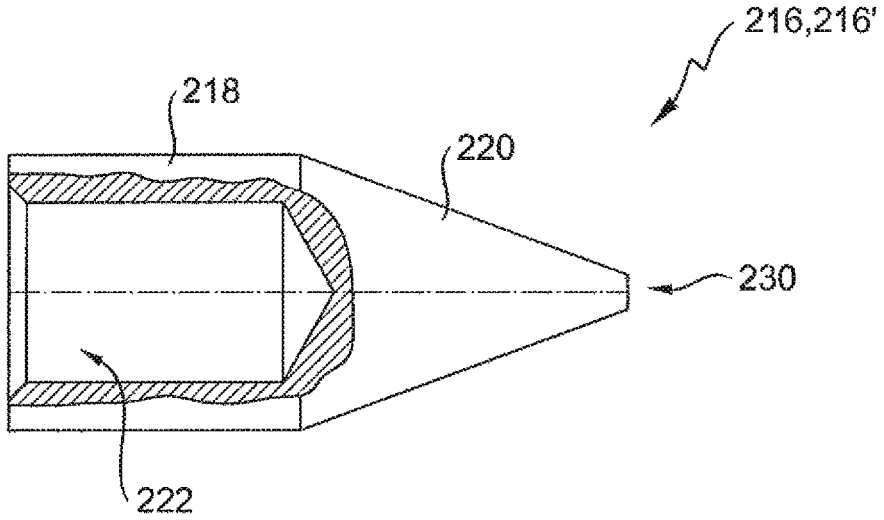

FIGS. 6 to 8 illustrate different exemplary embodiments relating to holding tips. FIG. 6 firstly shows holding tips 16, 16' which have a stump side 18 and a tip side 20. Both the stump side 18 and the tip side 20 are of cylindrical form, wherein the diameter of the stump side 18 is greater than the diameter of the tip side 20. The holding tip 16 comes into contact, by means of a contact surface 30, with a pipeline element 4 (not shown). In the stump side 18, there is formed a coupling recess, which may for example be in the form of a bore. The coupling recess thus defines a bushing by means of which the holding tip 16 can be mounted onto a correspondingly formed plug-in section 26. The tip geometry shown in FIG. 6 ensures that the contact surface 30 with a pipeline element 4 (not shown) is as small as possible and a pipeline element 4 can be flowed around in the most effective possible manner, but at the same time the holding tip 16 also provides the required strength and rigidity owing to its geometry.

An alternative exemplary embodiment of a holding tip 116, 116' is shown in FIG. 7. The holding tip 116, 116' again has a stump side 118 and a tip side 120, wherein a coupling recess 122 is formed in the stump side 118. Adjoining the tip side 120 and at the end averted from the stump side 118, a cone tip 130 is arranged on the tip side 120. By means of this cone tip 130, the contact surface with a pipeline element 4 (not shown) can be further reduced without adversely affecting the strength and rigidity of the holding tip 116, 116'.

A further alternative exemplary embodiment of a holding tip 216, 216' firstly again has a stump side 218 with a coupling recess 222 formed therein. In FIG. 8, however, the tip side 220 is of frustoconical form and, at the side averted from the stump side 218, defines a contact surface 230. In comparison with the holding tips 16, 16', 116, 116' shown in FIGS. 6 and 7, the holding tip 216, 216' shown in FIG. 8 has greater strength and rigidity and is therefore suitable for example in particular for very heavy pipeline elements 4, but likewise has a minimal effect on the flow around a pipeline element 4.

Figure 9:
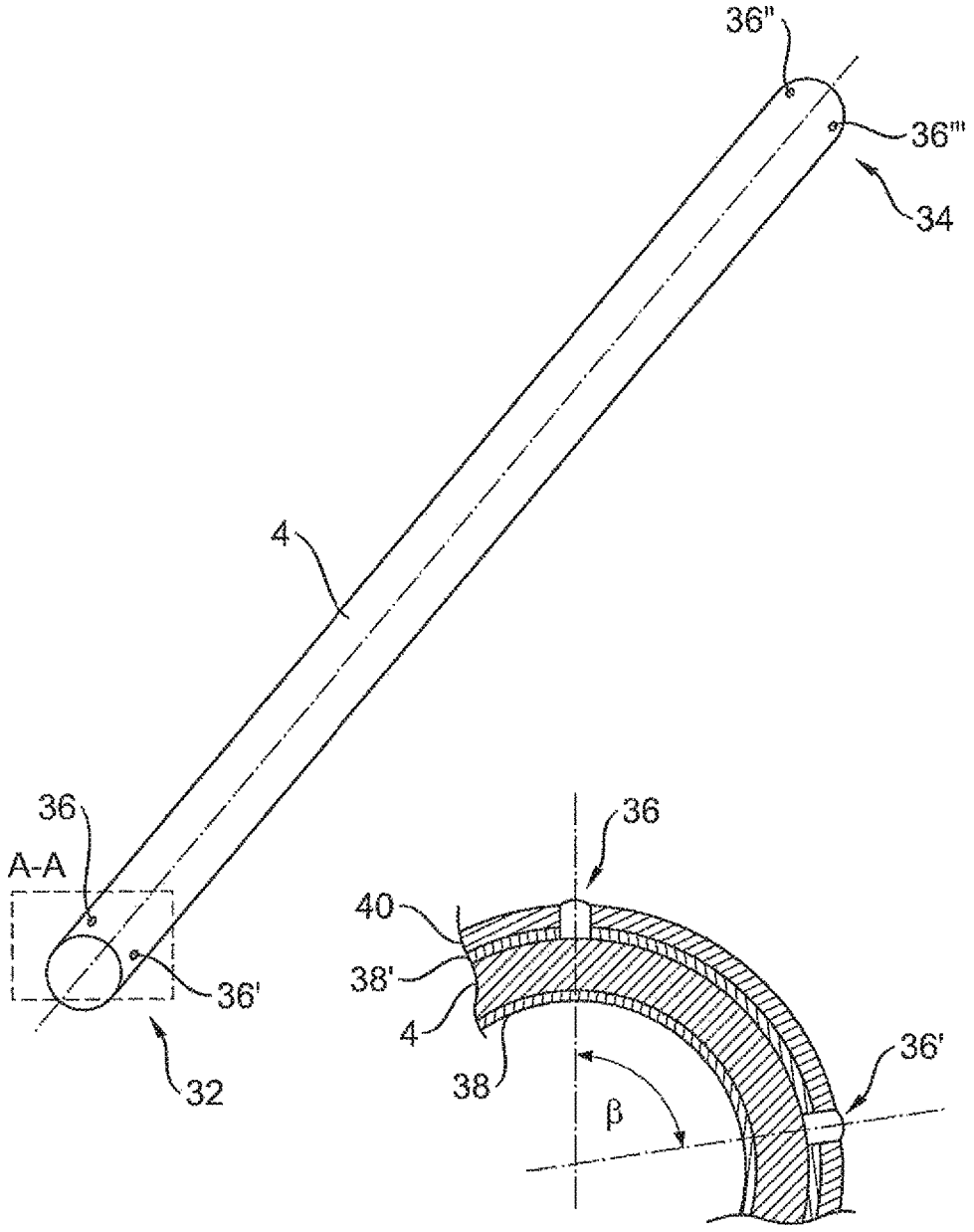
FIG. 9 shows a pipeline element produced by means of a carrying device as per FIGS. 1 to 8.

FIG. 9 shows a pipeline element 4 in a perspective view and in a sectional view. The pipeline element 4 has a first end region 32 and a second end region 34. As can be seen from the sectional view, the pipeline element 4 has a polymer coating 38, 38' in each case on its inside and on its outside. A powder coating 40 is additionally applied to the outside. Uncoated sections 36, 36', 36", 36", also referred to as defects, are arranged at the end regions 32, 34. The defects relate primarily to the layer region of the powder coating 40, though it is nevertheless possible for the polymer coating 38' to be formed with a reduced layer thickness, or to be at least locally not present, in these regions. The position of the uncoated sections 36, 36' corresponds to the angle of inclination with which the support feet 12, 12' face toward one another, and is therefore likewise denoted by β.

LIST OF UTILIZED REFERENCE NUMBERS

2 Carrying device
4 Pipeline element
6 Main body
8 Cantilever
10 Receptacle

12, 12' Support feet
14, 14' Wall sections of the pipeline element
16, 16' Holding tip
18, 18' Stump side
20, 20' Tip side
22, 22' Coupling recess
24, 24' Base portion of the support feet
26, 26' Plug-in section
28 Attachment section
30 Contact surface
32 First end region
34 Second end region
36, 36',
36", 36'" Uncoated sections
38, 38' Polymer coating
40 Powder coating
62 Angle between holding tip longitudinal axes
h Height between end of the support feet and cantilever top side
$d_1$, $d_2$ Cantilever spacing
102 Carrying device
106 Main body
108 Cantilever
116, 116' Holding tip
118 Stump side
120 Tip side
122 Coupling recess
124, 124' Base portion of the support feet
128 Attachment section
130 Cone tip
202 Carrying device
206 Main body
208 Cantilever
212, 212' Support feet
216, 216' Holding tip
218 Stump side
220 Tip side
222 Coupling recess
228 Attachment section
230 Contact surface
232 Strut
302 Carrying device
306 Main body
308 Cantilever
324, 324' Base portion of the support feet
328 Attachment section

The invention claimed is:

1. A carrying device for attaching to a conveying device mounted to a ceiling and receiving pipeline elements in a surface coating installation, comprising:

a main body, an attachment on the main body, and multiple cantilevers extending laterally from the main body, wherein each cantilever comprises a receptacle with a pair of support feet spaced apart from one another and oriented with respect to each other, wherein each of the support feet comprises a contact surface configured to come into contact with one outer wall section of a pipeline element in order to center the pipeline element between the support feet; and wherein the main body of the carrying device and/or the cantilever are formed from one of the following: sheet metal, one-piece sheet metal, or nonferrous metal.

2. The carrying device as claimed in claim 1, wherein the support feet are oriented so as to face toward one another at an angle of 35° to 95°.

3. The carrying device as claimed in claim 1, wherein the support feet comprise, at their end averted from the cantilever, a height of 30 mm to 80 mm in relation to a top side of the cantilevers.

4. The carrying device as claimed in claim 1, wherein each of the support feet comprise one holding tip with a stump side and a tip side, wherein the holding tip has a greater diameter at the stump side than at the tip side.

5. The carrying device as claimed in claim 4, wherein the holding tip has a coupling recess at the stump side, and a plug-in portion which corresponds to the coupling recess is formed on a base section of the support feet.

6. The carrying device as claimed in claim 4, wherein the holding tip has a cylindrical section and has a conical section adjoining the cylindrical section, wherein the conical section is configured to come into contact with the pipeline element.

7. The carrying device as claimed in claim 4, wherein the holding tip is formed as a separate, exchangeable component.

8. The carrying device as claimed in claim 4, wherein the holding tip is formed from one of the following materials: machining steel, or nonferrous metal.

9. The carrying device as claimed in claim 1, wherein, on the main body of the carrying device, at least two cantilevers are arranged spaced apart from one another along a longitudinal axis of the main body.

10. The carrying device as claimed in claim 1, wherein the cantilevers comprise a substantially horizontal orientation during operation.

11. The carrying device as claimed in claim 1, wherein the main body of the carrying device comprises a first side and a second side, wherein the cantilevers on the first side are arranged in alignment with or so as to be offset with respect to the cantilevers on the second side.

12. A system for transporting at least one pipeline element within a surface coating installation, the system including a conveying device mounted to a ceiling and comprising:

at least two carrying devices, which are attachable to the conveying device, for receiving pipeline elements, wherein each of the at least two carrying devices engage, spaced apart from one another, on a same pipeline element, and comprises: a main body, an attachment on the main body, and multiple cantilevers extending laterally from the main body, wherein each cantilever comprises a receptacle with a pair of support feet spaced apart from one another and oriented with respect to each other, wherein each of the support feet comprises a contact surface configured to come into contact with one outer wall section of the pipeline element in order to center the pipeline element between the support feet.

13. The system as claimed in claim 12, wherein the support feet are oriented so as to face toward one another at an angle of 35° to 95° .

14. The system as claimed in claim 12, wherein the support feet comprise, at their end averted from the cantilever, a height of 30 mm to 80 mm in relation to a top side of the cantilevers.

15. The system as claimed in claim 12, wherein each of the support feet comprise one holding tip with a stump side and a tip side, wherein the holding tip has a greater diameter at the stump side than at the tip side.

16. The system as claimed in claim 15, wherein the holding tip is formed as a separate, exchangeable component.

17. The system as claimed in claim 12, wherein the main body and/or the cantilever are formed from one of the following: sheet metal, one-piece sheet metal, or nonferrous metal.

18. The system as claimed in claim 12, wherein, on the main body, at least two cantilevers are arranged spaced apart from one another along a longitudinal axis of the main body.

19. The system as claimed in claim 12, wherein the cantilevers have a substantially horizontal orientation during operation.

20. The system as claimed in claim 12, wherein the main body comprises a first side and a second side, and wherein the cantilevers on the first side are arranged in alignment with or so as to be offset with respect to the cantilevers on the second side.

21. A method for producing a coated pipeline element of a fire extinguishing installation, the method comprising:

providing a pipeline element for coating, placing the pipeline element onto two carrying devices which are coupled to a conveying device mounted to a ceiling, wherein at least one of the carrying devices comprises: a main body, an attachment on the main body, and multiple cantilevers extending laterally from the main body, wherein each cantilever, comprises a receptacle with a pair of support feet spaced apart from one another and oriented with respect to each other, wherein each of the support feet comprises a contact surface configured to come into contact with one outer wall section of the pipeline element in order to center the pipeline element between the support feet;

conveying the pipeline element to a coating facility, and coating the pipeline element in the coating facility.

22. The method as claimed in claim 21, wherein the coating is performed in a polymer coating process, wherein the pipeline element remains on the carrying devices during the coating process and the pipeline element is inclined relative to a horizontal plane during the coating process.

23. The method as claimed in claim 22, wherein the coating is performed by chemical autodeposition, including dipping of the pipeline element into a dip bath which contains a polymer-based chemical autodeposition material.

24. The method as claimed in claim 23, wherein the autodeposition material comprises polymer constituents which are ionically bonded to a wall of the pipeline elements, and is present as an aqueous emulsion or dispersion.

25. The method as claimed in claim 23, wherein the autodeposition material is acidic, has a pH value in a range from 1 to 5, and comprises a starter material in the form of metal halides.

26. The method as claimed in claim 23, wherein the autodeposition material comprises, as polymer constituents, one or more autodepositionable polymers selected from the group consisting of: i) epoxides, ii) acrylates, iii) styrene acrylates, iv) epoxy acrylates, v) isocyanates, urethanes, or polyurethanes, vi) polymers with a vinyl group, polyvinylidene chloride, and iv) a combination of two or more of i), ii) and iii) crosslinked to one another via at least one of an isocyanate and a urethane.

27. The method as claimed in claim 23, wherein the dipping is continued in one or more dipping processes until such time as a polymer-based layer applied to the inside of the at least one pipeline element has a thickness in a range from 7 μm to 80 μm.

28. The method as claimed in claim 22, wherein the coating further comprises a powder coating method, wherein the at least one pipeline element remains on the carrying devices during the coating process.

29. The method as claimed in claim 28, wherein the pipeline element is subjected to at least partial thermal after: treatment before the powder coating method and/or after the powder coating method, wherein, powder provided for the powder coating method is electrostatically charged before and/or during the powder coating method, or the pipeline element provided for coating is electrostatically charged before and/or during the powder coating method.

30. The method as claimed in claim 21, wherein the support feet are oriented so as to face toward one another at an angle of 35° to 95°.

31. The method as claimed in claim 21, wherein the support feet comprise, at their end averted from the cantilever, a height of 30 mm to 80 mm in relation to a top side of the cantilevers.

32. The method as claimed in claim 21, wherein each of the support feet comprise one holding tip with a stump side and a tip side, wherein the holding tip has a greater diameter at the stump side than at the tip side.

33. The method as claimed in claim 32, wherein the holding tip is formed as a separate, exchangeable component.

34. The method as claimed in claim 21, wherein main body and/or the cantilever are formed from one of the following: sheet metal, one-piece sheet metal, or nonferrous metal.

35. The method as claimed in claim 21, wherein, on the main body, at least two cantilevers are arranged spaced apart from one another along a longitudinal axis of the main body.

36. The method as claimed in claim 21, wherein the cantilevers have a substantially horizontal orientation during operation.

37. The method as claimed in claim 21, wherein the main body comprises a first side and a second side, and wherein the cantilevers on the first side are arranged in alignment with or so as to be offset with respect to the cantilevers on the second side.

* * * * *